United States Patent [19]

Little

[11] Patent Number: 4,526,234

[45] Date of Patent: Jul. 2, 1985

[54] WETTING AGENT INJECTION SYSTEM

[76] Inventor: Ralph V. Little, 1910 N. 47th Ave. East, Duluth, Minn. 55804

[21] Appl. No.: 544,204

[22] Filed: Oct. 21, 1983

[51] Int. Cl.[3] ..... A62C 35/00

[52] U.S. Cl. ..... 169/15; 137/101.19

[58] Field of Search ..... 169/14, 15; 137/101.19, 137/114

[56] References Cited

U.S. PATENT DOCUMENTS

| | | | |
|---|---|---|---|
| 2,752,934 | 7/1956 | Badberg | 137/98 |
| 3,647,001 | 3/1972 | Livingston | 169/1 A |
| 3,846,515 | 11/1974 | Williamson | 261/18 B |
| 4,037,664 | 7/1977 | Gibson | 169/15 |
| 4,234,044 | 11/1980 | Hollan et al. | 169/14 |
| 4,278,132 | 7/1981 | Hostetter | 169/13 |

*Primary Examiner*—Andres Kashnikow
*Assistant Examiner*—Scott D. Malpede
*Attorney, Agent, or Firm*—Peterson, Wicks, Nemer & Kamrath

[57] ABSTRACT

A wetting agent injection system is shown according to the preferred embodiment of the present invention utilized with firefighting apparatus having a positive pressure pump. The purpose of the system is to automatically inject a wetting agent into the pump during its normal firefighting operation. The system is controlled by flow switches located on one or more discharge lines of the pump, by a float switch in the wetting agent supply tank, and by regulated air pressure in the wetting agent supply tank. When the flow switches detect water flowing and when the float switch does not detect an empty supply tank, they activate relays within the control box of the system, which in turn activate electric solenoid valves permitting wetting agent to be injected into the suction side of the pump. Once in the pump, the wetting agent rapidly mixes with the water. The water treated with wetting agent penetrates better, reaching deeper into the material mass than untreated water can. Adjustable metering valves at the point of injection are further provided for allowing different flow settings and wetting agent viscosities.

9 Claims, 1 Drawing Figure

WETTING AGENT INJECTION SYSTEM

BACKGROUND

The present invention relates generally to wetting agent injection systems and more specifically to wetting agent injection systems for firefighting apparatuses.

It has been established for some time that water treated with a wetting agent is more effective on a Class A fire where good water penetration is needed to reach and extinguish the seat of the fire. Prior to the present invention, wetting agents were poured into the desired amount of water located in the tank of a water truck, and the water was then pumped onto the fire. Many disadvantages flow from this technique. Specifically, it was necessary to always have a water tank truck available for this purpose. For example, when water was being supplied by a fire hydrant or by drafting operations such as taking water from a lake or a pond, it was necessary to first pump the water into the water tank, apply the wetting agent, and then pump the treated water from the water tank onto the fire. Other disadvantages also arise from having the wetting agent in the tank. First, some wetting agents are corrosive in nature and will, in time, rust out the tank. Therefore, much flushing of the water tank is required to clean out the tank to rid it of any wetting agent residue. Further, any wetting agent left in the tank when mixed with firefighting foam breaks the foam down defeating the effectiveness of the firefighting foam. Therefore, a need has arisen for a wetting agent injection system for injecting wetting agents into the suction side of the pump which then mixes with the water within the pump and as it travels through the hose line rather than requiring the mixing of the wetting agent in a water holding tank.

SUMMARY

The present invention solves these and other problems in firefighting by providing, in the preferred embodiment, a wetting agent injection system utilized with firefighting apparatus having a positive pressure pump. Specifically, the injection system includes a supply tank in fluid communication with a solenoid valve, which in turn is in fluid communication with the suction side of the positive pressure pump. In its most preferred form, the system is electro-pneumatically controlled. Specifically, the supply tank is pressurized and can be regulated to force the wetting agent from the supply tank through the fluid conduit to the suction side of the pump when the solenoid valve is open. Detectors for detecting flow in one or more discharge lines of the pump and supply level detectors for detecting the condition of the supply tank are provided for activating an electric solenoid valve permitting the wetting agent to be injected into the pump due to the pressurized condition of the supply tank.

Thus, it is an object of the present invention to provide a novel wetting agent injection system.

It is also an object of the present invention to provide such a novel wetting agent injection system utilized with firefighting apparatus having a positive pressure pump.

It is also an object of the present invention to provide such a novel wetting agent injection system where the wetting agent is introduced into the suction side of the pump and mixes with the water within the pump and as it travels through the discharge lines.

It is also an object of the present invention to provide such a novel wetting agent injection system which allows automatic operation.

It is also an object of the present invention to provide such a novel wetting agent injection system which requires minimal adjustment or attention.

It is also an object of the present invention to provide such a novel wetting agent injection system which has an automatic shutdown feature when the wetting agent holding tank is empty or when flow through the discharge lines is stopped.

It is also an object of the present invention to provide such a novel wetting agent injection system which has few moving parts and which requires no expensive motor or air driven wetting agent pumps.

These and further objects and advantages of the present invention will become clearer in light of the following detailed description of an illustrative embodiment of this invention described in connection with the drawing.

DESCRIPTION OF THE DRAWING

The illustrative embodiment may best be described by reference to the accompanying FIG. 1 showing a schematic/diagrammatic view of a wetting agent injection system according to the preferred embodiment of the teachings of the present invention.

The FIGURE drawn for ease of explanation of the basic teachings of the present invention only; the extensions of the figure with respect to number, position, relationship, exact electrical connection, precise logical configuration, and dimensions of the parts to form the preferred embodiment will be explained or will be within the skill of the art after the following teachings of the present invention have been read and understood.

DESCRIPTION

Figure 1:
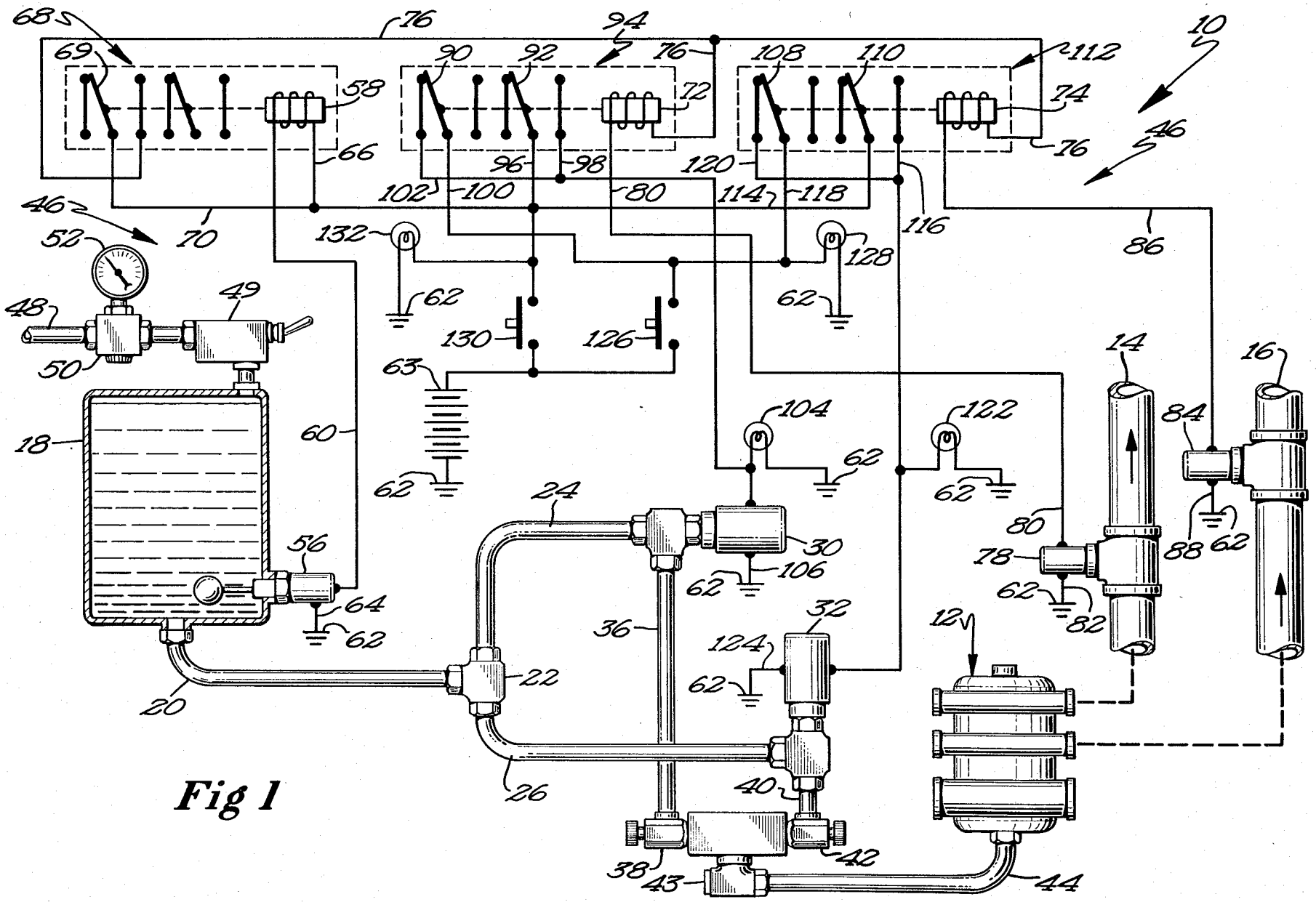

A wetting agent injection system according to the teachings of the present invention is shown in the drawings and generally designated 10. System 10 is preferrably utilized with fire fighting apparatus having a centrifugal or positive pressure pump 12 in fluid connection with hose lines, shown in the most preferred form as including two hose lines 14 and 16. It can then be appreciated that the appropriate firefighting apparatus can include fewer or more hose lines, as desired.

System 10 includes a wetting agent supply tank 18 in fluid communication by means of conduit 20 to wetting agent filter 22. Filter 22 is in fluid communication by means of conduits 24 and 26 to solenoid valves 30 and 32, respectively. Solenoid valve 30 is in fluid communication by means of conduit 36 to metering valve 38. Solenoid valve 32 is in fluid communication by means of conduit 40 to metering valve 42. In their most preferred forms, metering valves 38 and 42 are adjustable needle type valves. Metering valves 38 and 42 are in fluid communication through check valve 43 by means of conduit 44 to the suction side of pump 12. Check valve 43 prevents water from flowing into or through valves 38 and 42 from pump 12.

Due to the corrosive nature of some wetting agents, all components in contact with the wetting agent such as tank 18, conduits 20, 24, 26, 36, 40, and 44, filter 22, and valves 30, 32, 38, 42, and 43 should be made of a non-ferrous material or a good grade of stainless steel to counteract the possible corrosive effects of the wetting agent.

In addition to the intrinsic control created by the length and diameter of conduits 20, 24, 26, 36, 40, and 44, the size and adjustment of valves 30, 32, 38, 42, and 43, and the size of filter 22, system 10 further includes control apparatus 46 for controlling the flow and flow amount of the wetting agent. Specifically, preferred system 10 includes provision for pressurizing supply tank 18. Particularly, system 10 includes a conduit 48 in fluid communication between supply tank 18 and an air supply, such as the air supply of the fire fighting apparatus or a compact air compressor. Conduit 48 includes a shut-off valve 49 for stopping air pressure into tank 18 and for removing any residual air pressure in tank 18 when it is desired to depressurize tank, such as in the case of refilling. Conduit 48 further includes an adjustable regulator 50 for regulating the amount of air pressure allowed within supply tank 18 and a pressure gauge 52 for visually indicating the pressure within tank 18.

It can then be appreciated that the wetting agent flow from tank 18 into system 10 can be regulated by regulating the air pressure into tank 18 by utilizing regulator 50 according to the particular desires of the user. The pressure requirements for the proper flow of wetting agent is determined at the time of installation and is based upon several factors including the wetting agent viscosity, amount of wetting agent to be injected, the intrinsic controls of system 10, the adjustment of valves 30, 32, 38, and 42, and the residual pump pressure. Also, adjustment of regulator 50 may be desired depending on the source of water from which pump 12 is pumping from. The pressure requirements will be within the skill of persons in the art after the teachings of the present invention are known.

Supply tank 18 should be strong enough to withstand an internal pressure of 150 psi and should have a sufficient size to hold the desired amount of wetting agent. For example, typically a one gallon tank will treat from 4800 to 48,000 gallons of water, depending on the intrinsic controls created by the length and diameter of conduits 20, 24, 26, 36, 40, and 44 and the size and setting of valves 30, 32, 38, and 42, whether the maximum gallons are being pumped, and the air pressure being supplied to the supply tank as compared to the pressure conditions existing on the suction side of pump 12.

Furthermore, system 10 includes provision for electronically controlling solenoid valves 30 and 32. Particularly, system 10 includes supply tank level indicator 56 shown in its most preferred form as a float switch. Float switch 56 is in electrical connection to a logic element shown in its most preferred form as a relay 68 including a switch 69 and a coil 58. Specifically, float switch 56 is in electrical connection to coil 58 as by wire 60. Further, float switch 56 is electrically connected to ground 62 by means of wire 64. Coil 58 is further connected to a power source 63, such as the 12 volt battery of the firefighting apparatus, by means of wire 66.

Coil 58 acts upon normally closed switch contacts 69 of control relay 68. Switch 69 is in electrical connection to power source 63 by means of wire 70 and is also in electrical connection to coils 72 and 74 of second and third logic elements 94 and 112 by means of wire 76. Coil 72 is in further electrical connection to a flow detector shown in its most preferred form as a flow switch 78 by means of wire 80. Flow switch 78 is in electrical connection with ground 62 by means of wire 82. In a similar manner, coil 74 is in electrical connection with a flow switch 84 by means of wire 86 and flow switch 84 is in turn electrically connected to ground 62 by means of wire 88.

Coil 72 acts upon normally closed switch contacts 90 and normally open switch contacts 92 of control relay 94. Switch 92 is in electrical connection to power source 63 by means of wire 96 and is in electrical connection to solenoid valve 30 by means of wire 98. Switch 90 of relay 94 is in electrical connection to power source 63 by means of wire 100 and is electrically connected to solenoid valve 30 by means of wire 102. Wires 98 and 102 can further include an indicator light 104 for indicating activation of solenoid valve 30. Solenoid valve 30 is electrically connected to ground 62 by means of wire 106.

In a similar manner, coil 74 acts upon switches 108 and 110 of relay 112. Normally open switch 110 is in electrical connection with power source 63 by means of wire 114 and is in electrical connection with solenoid valve 32 by means of wire 116. Switch 108 is in electrical connection to power source 63 by means of wire 118 and is in electrical connection to solenoid valve 32 by means of wire 120. Wires 116 and 180 can further include an indicator light 122 for indicating activation of solenoid valve 32. Solenoid valve 32 is electrically connected to ground 62 by means of wire 124.

Wires 100 and 118 can further include an override switch 126 and an indicator light 128 showing activation of the override switch. Wires 66, 70, 96, and 114 can further include a start switch 130, and an indicator light 132 can be provided showing activation of start switch 130.

Now that the structure of the present invention has been set forth, the operation and subtle features of the present invention can be set forth and appreciated. For purposes of explanation, a first condition will be assumed, i.e., that wetting agent supply tank 18 is empty. When tank 18 is empty, float switch 56 is normally open thus not applying voltage to coil 58. Thus, coil 58 does not act on normally open switch 69 of relay 68 and no voltage is applied to coils 72 or 74 or to flow switches 78 or 84. Since switches 92 and 110 are normally open and are not acted upon by coils 72 and 74, solenoid valves 30 and 32 are not energized and remain in their normally closed position. Thus, when coil 58 is not energized, voltage is not applied to lights 104 and 122 of the control panel indicating no flow of wetting agent.

It can then be appreciated that no matter what the condition of flow switches 78 and 84, i.e., whether or not flow is occurring through lines 14 or 16, due to the lack of application of voltage to coils 72 and 74 as caused by float switch 56 in the assumed tank empty condition, solenoid valves 30 and 32 will not be activated, except through utilization of override switch 126. Therefore, system 10 has an automatic shut down feature whenever holding tank 18 is or becomes empty, the first condition of this operation explanation. Further, to reemploy the system, it is only necessary to refill supply tank 18 placing the system in a second condition of this operation explanation discussed hereinafter.

If it is desired to energize valves 30 and 32 although the float switch 56 registers an empty tank, such as when it is desired to completely empty system 10, voltage can be applied to solenoid valves 30 and 32 by activation of override switch 126 thus providing voltage from power source 63 to ground 62 by means of wires 100, 102, 106, 118, 120, and 124 and switches 90 and 108.

Next, for purposes of explanation, a second condition will be assumed, i.e., that supply tank 18 has the required amount of wetting agent such that float switch 56 is activated, thus moving from its open electrical position to a closed electrical condition. Therefore, voltage is applied to coil 58 from power source 63 through wires 60, 64, and 66 to ground 62 through switch 130. Voltage on coil 58 causes the contacts of switch 69 of relay 68 to move from a normally open electrical condition to a closed electrical condition. Therefore, voltage is applied through coils 72 and 74 to flow switches 78 and 84 by wires 70, 76, 80, and 86. Thus, with tank 18 having the required amount of wetting agent, system 10 is in its automatic operation mode where system 10 will be activated automatically when flow begin through discharge lines 14 and/or 16.

It can then be appreciated that there are two further subconditions or possibilities; namely, water flow through hoses 14 and/or 16 or no flow through hoses 14 and 16. For purposes of explanation, a first subcondition will be assumed, i.e., that no flow occurs through either hose 14 or 16. With a no flow condition, flow switches 78 and 84 remain in a normally open condition preventing energization of coils 72 and 74. Therefore, switches 92 and 110 remain in their normally open condition and do not provide voltage to the normally closed solenoid valves 30 and 32. It can then be noted that voltage can be applied to solenoid valves 30 and 32 by engaging override switch 126 even though flow switches 78 and 84 are in their normally open condition in a similar manner as when it is desired to override system 10 when tank 18 is detected as being empty by float switch 56.

For purposes of explanation, a second subcondition will be assumed, i.e., that flow is occurring through hose 14. With flow occurring through hose 14, flow switch 78 moves from its normally open condition to a closed condition and the circuit between battery 63 and ground 62 is completed as by wires 70, 76, 80, and 82. Thus, coil 72 is energized moving switch contacts 92 from a normally open condition to a closed condition. Therefore, voltage is applied to solenoid valve 30 and indicator light 104 through switch 92 by wires 96, 98, and 106 opening valve 30 allowing flow of wetting agent from tank 18 through conduits 20, 24, 36, and 44 under action of the air pressure introduced into tank 18 by conduit 48. Coil 72 also moves switch contacts 90 from a normally closed condition to an open condition preventing energization through override switch 126.

It should be appreciated that if supply tank 18 should go empty and/or should flow through hose 14 cease, coil 72 will be deenergized, and thus will not act on switch contacts 92 allowing switch 92 to move from its closed position to its normally open condition and thus deenergizing solenoid valve 30. In its deenergized condition, valve 30 moves from its open position to its normally closed position preventing flow of wetting agent through conduit 36.

Flow switch 84, coil 74, relay 112, light 122, and solenoid valve 32 operate in a similar manner as set forth with respect to flow switch 78, coil 72, relay 94, light 104, and solenoid valve 30 and its operation will not be repeated here. However, note that the operation of coil 74, flow switch 84, relay 112, light 122, and solenoid valve 32 is independent of coil 72, flow switch 78, relay 94, light 104, and solenoid valve 30 allowing independent operation of solenoid valves 30 and 32 such that valve 32 can be either in its open or closed postion no matter what the condition of valve 30.

It can then be appreciated that system 10 provided significant advantages over prior wetting agent introduction systems. First, the wetting agent is introduced into the pump and specifically not into a holding tank as was required in the prior art. Thus, disadvantages of mixing within a holding tank including the flushing of the holding tank to remove any residue is not required. The only flushing required of system 10 is running clear water through pump 12 to remove any residue therefrom. Further, system 10 is not dependent upon the source of water since the wetting agent is introduced into pump 12 and thus the water source can be a fire hydrant, a drafting operation such as from a lake or pond, or from a water holding tank.

Furthermore, introduction of the wetting agent in the suction side of pump 12 insures a thorough mixing thereof and a better mixing than may occur when the wetting agent was simply dumped into a holding tank or introduced into the discharge lines.

Additionally, during the initial stages of attacking a fire, water penetration is of the utmost importance and thus the treatment of water by a wetting agent is very important. However, at the initial stages of attacking a fire, the pump operator is the busiest and prior to the present invention, the introduction of wetting agent into the water was delayed due to the disadvantages of prior wetting agent introduction methods. Utilizing the present invention, it is only necessary to activate switch 130 and system 10 automatically operates and maintains itself. Specifically, it should be noted that the wetting agent can be filled in tank 18 and can be in a standby condition if and when it is desired to treat water utilized in fighting fires. Thus, system 10 will be in the second condition of operation as set forth hereinbefore. When water. is being discharged through lines 14 and/or 16, the flow is detected by switches 78 and/or 84 activating solenoid valves 30 and 32 instantly as set forth in the second subcondition of the operation described hereinbefore without further assistance of the pump operator. Additionally, should more or fewer discharge lines be employed, system 10 automatically adjusts the concentration of the wetting agent according to the flow detection in each of the discharge lines. Likewise, if supply tank 18 should go empty, system 10 is automatically deactivated by float switch 56 without operator assistance and to reemploy system 10, it is only necessary to refill tank 18 with wetting agent.

Further, it can be appreciated that system 10 is particularly advantageous in its easy adaption for use with one, two, or more discharge lines while utilizing a single source of wetting agent. Further, activation of a single switch 130 activates the entire system, and automatic injection of the correct amount of wetting agent into the pump is provided upon start of flow in the discharge lines as they are placed into use.

Furthermore, it should be noted that metering valves 38 and 42 may be adjusted for the estimated volume of water which is expected to pass through their corresponding discharge lines 14 and 16. Discharge lines generally include nozzles allowing throttling down of the flow of water. It can then be appreciated that by throttling down the amount of water flowing through the lines by the discharge nozzles, a higher concentration of wetting agent within the water flow may be obtained. Therefore, when a richer concentration of wetting agent is desirable, such as during the overhaul and mop up operation of fires, it is only necessary to throttle down the discharge nozzle without any further adjustments. Thus, less manhours are spent at the fire scene and the problem of rekindling should be less frequent.

Likewise, system 10 has few moving parts requiring little maintenance and does not require expensive air or motor driven pumps for the wetting agent. Further, very little power is required in operating system 10. In the most preferred form of the present invention, the power sources for system 10 utilized, i.e., the source of air pressure for tank 18 and battery 63, are generally standard equipment available on fire fighting apparatus, and thus no separate power sources are required for system 10. Thus, system can be inexpensively added to existing firefighting apparatus. Additionally, system 10 is of a very compact design utilizing only one and one-half cubic feet of space in the preferred embodiment of the present invention allowing its installation behind the driver's seat of a fire pumper. It should be noted that there are no limiting factors concerning mounting sites for system 10, except where extreme low temperatures are encountered causing the wetting agent to thicken and change its flow characteristics.

Now that the basic teachings of the present invention have been explained, many extensions and variations will be obvious to one having ordinary skill in the art. For example, the normal conditions of relays 68, 94, and 112, switches 56, 78, 84, and solenoid valves 30 and 32 can be varied according to the particular desires of the designer. For example, although solenoid valves 30 and 32 are shown in their most preferred forms as having a normally closed condition and when activated move to an open condition, the solenoid valves can be modified to be in a normally open position and when energized move to a closed position, which modification would then require other modifications in control apparatus 46.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Wetting agent injection system for use with a firefighting apparatus, with the firefighting apparatus having a positive pressure pump including a suction side and including at least a first discharge line, comprising, in combination: a wetting agent supply tank; at least a first solenoid valve having an open position and a closed position; means for providing fluid communication from the wetting agent supply tank to the solenoid valve; means for providing fluid communication between the solenoid valve and the suction side of the positive pressure pump of the firefighting apparatus; and means for controlling the flow and flow amount of the wetting agent from the supply tank to the pump, with the control apparatus comprising, in combination: means for connecting the interior of the wetting agent supply tank to a source of pressurized air, with the pressurized air connecting means including means for regulating the air pressure supplied into the wetting agent supply tank; means for detecting the level of the wetting agent in the supply tank; means for detecting flow of water through the discharge line of the firefighting apparatus; and means for energizing the solenoid valve according to the level of the wetting agent in the wetting agent supply tank and the flow of water from the pump through the discharge line for moving the solenoid valve to its closed position preventing fluid flow from the supply tank to the pump when the condition of the supply tank is detected by the level detecting means as being empty, for moving the solenoid valve to its closed position preventing fluid flow from the supply tank to the pump when the condition of the supply tank is detected by the level detecting means as not being empty and the condition detected by the flow detecting means is that no flow is occurring through the discharge line and for moving the solenoid valve to its open position allowing fluid flow from the supply tank to the pump when the condition of the supply tank is detected by the level detecting means as not being empty and the condition detected by the flow detecting means is that flow is occurring through the discharge line.

2. The wetting agent injection system of claim 1 wherein the means for providing fluid communication between the solenoid valve and the suction side of the positive pressure pump includes a metering valve for adjustably metering the flow of the wetting agent between the solenoid valve and the suction side of the pump, and a check valve for preventing flow of water from the pump to the solenoid valve or the metering valve; and Wherein the means for providing fluid communication from the supply tank to the solenoid valve includes a filter for filtering any foreign material from the wetting agent prior to its introduction and passage through the solenoid valve.

3. The wetting agent injection system of claim 1 further comprising, in combination: an override switch; and means for electrically connecting the override switch with the power source and the solenoid valve wherein the solenoid valve can be energized by activation of the override switch even if the condition of the supply tank is detected as being empty by the level detecting means and even if no flow of water is detected through the discharge line of the pump by the flow detecting means.

4. The wetting agent injection system of claim 1 wherein the solenoid valve energizing means comprises, in combination: a first relay having a coil; means for electrically connecting the coil of the first relay with the level detecting means and a source of power; a second relay having a coil; means for electrically connecting the first relay, the coil of the second relay and the flow detecting means with the source of power; and means for electrically connecting the solenoid valve and the second relay with the source of power.

5. The wetting agent injection system of claim 4 wherein the second relay includes a normally open switch, wherein the second relay and the solenoid valve electrically connecting means comprises means for electrically connecting the normally open switch of the second relay with the solenoid valve and the power source, wherein the solenoid valve is in a normally closed condition, and wherein when the condition of the supply tank is not detected as being empty by the level detecting means and flow is detected by the flow detecting means, it is necessary to energize the coil of the second relay moving the normally open switch of the second relay to a closed condition.

6. The wetting agent injection system of claim 4 wherein the first relay includes a normally open switch, wherein the first relay and flow detecting means electrically connecting means comprises means for electrically connecting the normally open switch of the first relay, the coil of the second relay and the flow detecting means with the source of power, wherein when the condition of the supply tank is not detected as being empty by the level detecting means, it is necessary to energize the coil of the first relay moving the normally open switch of the first relay to its closed condition.

7. The wetting agent injection system of claim 1 wherein the positive pressure pump includes a second discharge line, and wherein the wetting agent injection system further comprises, in combination: a second solenoid valve having an open position and a closed position; means for providing fluid communication from the wetting agent supply tank to the second solenoid valve; means for providing fluid communication between the second solenoid valve and the suction side of the positive pressure pump of the firefighting apparatus, with the control apparatus further comprising, in combination: means for detecting flow of water through the second discharge line of the firefighting apparatus; and means for energizing the second solenoid valve according to the level of the wetting agent in the wetting agent supply tank and the flow of water from the pump through the second discharge line for moving the second solenoid valve to its closed position preventing fluid flow from the supply tank to the pump when the condition of the supply tank is detected by the level detecting means as being empty, for moving the second solenoid valve to its closed position preventing fluid flow from the supply tank to the pump when the condition of the supply tank is detected by the level detecting means as not being empty and the condition detected by the second discharge line flow detecting means is that no flow is occurring through the second discharge line and for moving the second solenoid valve to its open position allowing fluid flow from the supply tank to the pump when the condition of the supply tank is detected by the level detecting means as not being empty and the condition detected by the second discharge line flow detecting means is that flow is occurring through the second discharge line.

8. The wetting agent injection system of claim 7 wherein the solenoid valve energizing means comprises, in combination: a first relay having a coil; means for electrically connecting the coil of the first relay with the level detecting means and a source of power; a second relay having a coil; means for electrically connecting the first relay, the coil of the second relay and the flow dectecting means with a source of power; and means for electrically connecting the solenoid valve and the second relay with the source of power.

9. The wetting agent injection system of claim 8 wherein the solenoid valve energizing means comprises, in combination: a third relay having a coil; means for electrically connecting the first relay, the coil of the third relay and the second discharge line flow detecting means with the source of power; and means for electrically connecting the second solenoid valve and the third relay with the source of power.

* * * * *